US012484686B2

(12) United States Patent
Dong

(10) Patent No.: US 12,484,686 B2
(45) Date of Patent: Dec. 2, 2025

(54) EXPANDABLE CARRIERS AND BACKPACKS

(71) Applicant: Shuyu Dong, San Francisco, CA (US)

(72) Inventor: Shuyu Dong, San Francisco, CA (US)

( * ) Notice: Subject to any disclaimer, the term of this patent is extended or adjusted under 35 U.S.C. 154(b) by 390 days.

(21) Appl. No.: 18/193,510

(22) Filed: Mar. 30, 2023

(65) Prior Publication Data

US 2023/0389675 A1 Dec. 7, 2023

Related U.S. Application Data

(60) Provisional application No. 63/347,879, filed on Jun. 1, 2022.

(51) Int. Cl.
*A45F 3/04* (2006.01)

(52) U.S. Cl.
CPC ..... *A45F 3/04* (2013.01)

(58) Field of Classification Search
CPC ... A45F 3/04; A45C 7/0086; A45C 2003/005; A45C 13/30; A45C 13/36
See application file for complete search history.

(56) References Cited

U.S. PATENT DOCUMENTS 3,122,225 A * 2/1964 Ward ..... A45C 7/0063 D3/902
4,334,601 A * 6/1982 Davis ..... A45C 3/00 190/111
4,491,258 A * 1/1985 Jones ..... A45F 4/02 224/153
5,458,278 A 10/1995 Laconte
5,934,533 A 8/1999 Callanan
6,863,201 B2 3/2005 Esqueda
6,886,726 B1 * 5/2005 O'Hare ..... A45F 3/02 224/625
7,160,028 B1 1/2007 Linday
9,119,448 B1 9/2015 Hirshberg
9,516,935 B2 * 12/2016 Rorie ..... A45C 3/12
9,555,308 B2 * 1/2017 Nassanian ..... A45F 3/04
10,165,841 B2 * 1/2019 Dalton ..... A45C 13/30
11,213,111 B1 * 1/2022 Hott ..... A45F 3/04
2008/0029562 A1 * 2/2008 Hawkins ..... A45F 3/04 224/153

(Continued)

OTHER PUBLICATIONS

Fenty Lace-Up Backpack, accessed May 31, 2021 from https://www.shiekh.com/.

(Continued)

*Primary Examiner* — Brian D Nash
(74) *Attorney, Agent, or Firm* — Perkins Coie LLP

(57) ABSTRACT

A backpack or carrier has a first and second shells each having a set of spaced apart openings. A first cord is threaded through the openings. The openings may or may not be laterally aligned with each other, and they may be formed by holes punched through the fabric of the carrier and reinforced by grommets. An additional second cord may be threaded through the openings on a second side. The second shell can be separable from the first shell by loosening the first cord and/or second cords. The first shell can be permanently joined to the second shell at a bottom of the carrier. Since the carrier can be expanded, it is well adapted for holding bulky items.

19 Claims, 15 Drawing Sheets

(56) References Cited

U.S. PATENT DOCUMENTS

| | | | | |
|---|---|---|---|---|
| 2008/0264986 | A1* | 10/2008 | Roden | A45F 3/04 224/153 |
| 2012/0192335 | A1* | 8/2012 | Crye | F41H 1/02 2/102 |
| 2012/0243806 | A1 | 9/2012 | Parks | |
| 2013/0185853 | A1* | 7/2013 | Ricart | A45F 3/14 224/259 |
| 2016/0174633 | A1* | 6/2016 | Macrae | A45F 3/04 2/69.5 |
| 2017/0143105 | A1* | 5/2017 | Schofield | A45F 3/04 |
| 2017/0318941 | A1* | 11/2017 | Vaughan | F41H 1/02 |
| 2019/0021475 | A1* | 1/2019 | Lindenmeyer | A45F 4/08 |
| 2021/0219703 | A1 | 7/2021 | Yoo | |
| 2023/0165359 | A1* | 6/2023 | Kukathas | A45C 13/30 224/645 |
| 2024/0057748 | A1* | 2/2024 | Haines | A45C 13/002 |

OTHER PUBLICATIONS

Guitar Box Strap Case, 41 Inches; accessed May 31, 2021, https://www.aliexpress.com/.

Original S.W.A.T. 8 Eyelet Zipper, accessed May 31, 2021, https://originalfootwear.com/products/product-rapid-response-zippers-8-coyote.

Pastel Lace Up Backpack sold by Littlepinko on Storenvy accessed May 31, 2021, https://www.storenvy.com/products/19835804-pastel-lace-up-backpack.

Pocket Front Lace Up Backpack, accessed May 31, 2021, https://us.shein.com.

Targus—16" Drifter II Laptop Backpack, accessed May 31, 2021, https://www.bestbuy.com/site/targus-16-drifter-ii-laptop-backpack-black/4218623.p?skuId=4218623.

* cited by examiner

EXPANDABLE CARRIERS AND BACKPACKS

CROSS-REFERENCE TO RELATED APPLICATION(S)

This application claims the benefit of and priority to U.S. Application No. 63/347,879, filed Jun. 1, 2022, incorporated herein by reference.

BACKGROUND

Backpacks, sports equipment bags, duffle bags, luggage and similar carriers generally have a fixed configuration and are not well suited for carrying bulky, long or odd-size objects. Accordingly, there is a need for improved carriers. Although a backpack is described below, similar designs and modifications may be used to expand the capacity of other carriers.

SUMMARY

On opposing sides of the opening of a backpack (i.e., along each side of a zipper track, which is often used to close such backpacks), modifications allow the passage of cords that can weave across the opening. These modifications can be permanent alterations to the backpack, such as the addition of eyelets, or add-ons to the backpack. The backpack may then be drawn closed and the contents secured in a number of ways. For example, the cords that weave through each side can be tensioned at the top and tied off together.

BRIEF DESCRIPTION OF THE DRAWINGS

In the drawings, the same element number indicates the same element in each of the views.

DETAILED DESCRIPTION

Figure 1B:
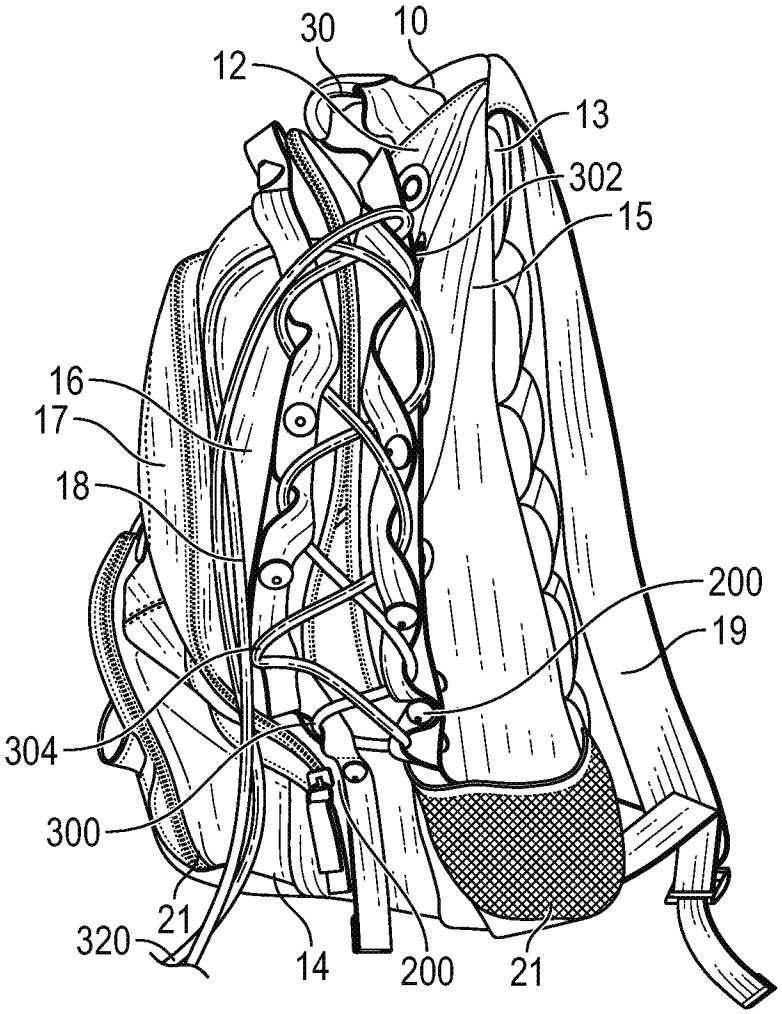
FIG. 1B shows a backpack from the left side view with a second type of modification.
Figure 1A:
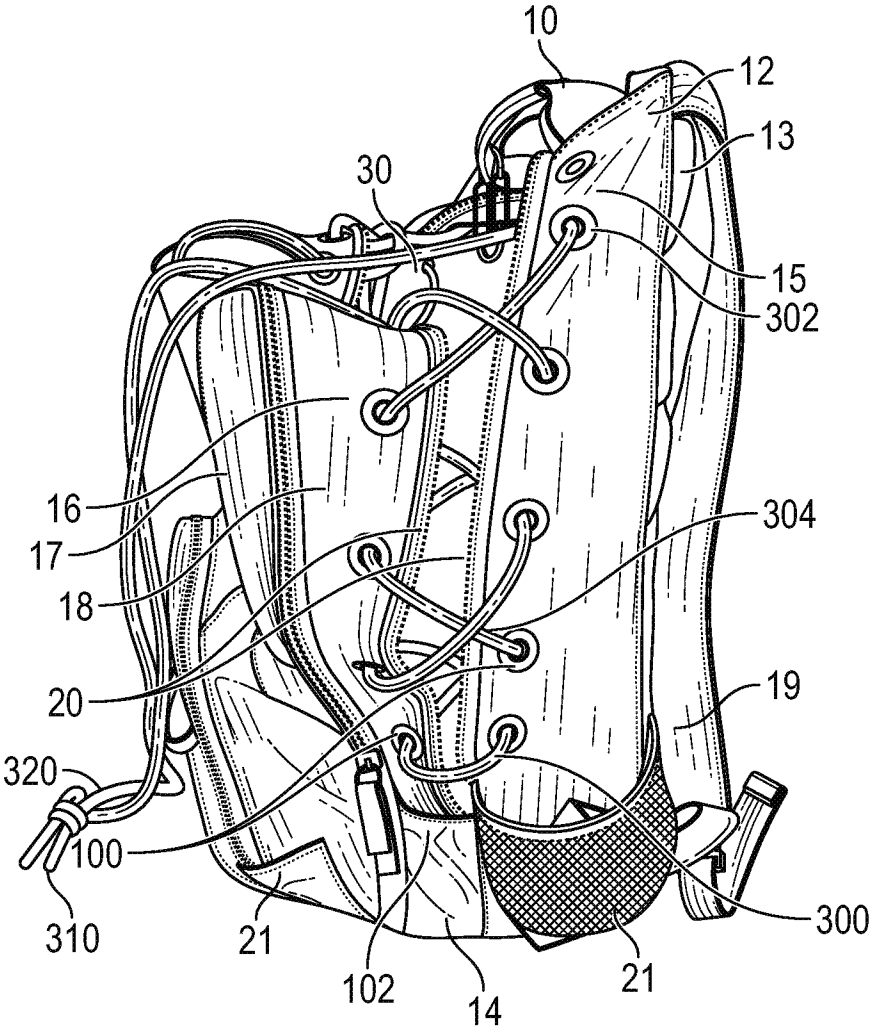
FIG. 1A shows a backpack from the left side view with a first type of modification.

As shown in FIG. 1A, a standard backpack 10 has a first shell 12 which has a first backwall 13 joined to or formed with first sidewall 15. The second shell 16 similarly has a second backwall 17 joined to or formed with sidewall 18. The backwalls and sidewalls are both joined to or formed with bottom 14. A pair of shoulder straps 19 may be attached to the first shell 12. Opposite to the backwalls, each shell features a zipper strip 20 (most clearly visible in FIG. 1A) that runs the length of the backpack opening 30, which, along with a zipper slider that can be pulled to close the opening, form a conventional zipper. The elements described above may be provided as with other well-known elements of a conventional backpack, such as optional additional pocket compartments 21.

Figure 4A:
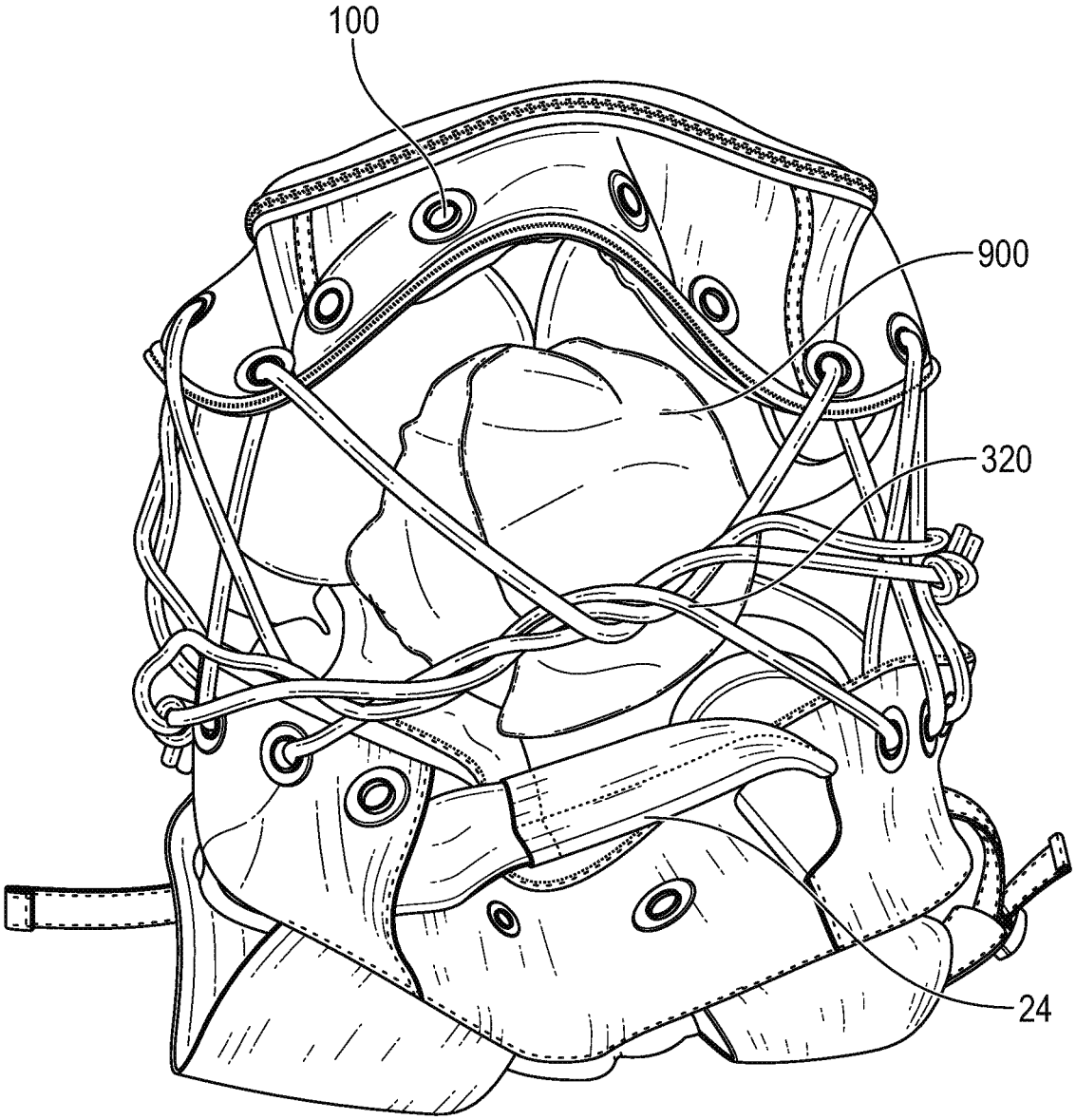
FIG. 4A shows a backpack from the top view with bulky contents and a first embodiment for securing the top.

Modifications are made to the backpack along the zipper strips 20 that allow cord to be weaved or laced across the opening 30. Two such possible modifications are described and pictured in FIGS. 1A and 1B. All Figures could be replicated with either example type of modification (e.g., FIGS. 7 through 10 may be duplicated with strap strips) or a mixture of both (e.g., FIG. 12), and only some Figures have both modification types shown to highlight specific features (e.g., FIGS. 4A and 6 show how tops may be secured differently). Either modification should be located fairly close to the opening 30 along each backpack shell (typically close to or overlapping with the zipper strip 20).

Referring to FIG. 1A, each shell features a set of spaced apart openings eyelets 100 created by metal grommets, placed in a row parallel to the zipper strips 20 on each shell. Each row of eyelets may start and end on each side of the backpack where the zipper strips terminate 102, i.e., where sidewalls 15 and 18 join together and with bottom 14.

Referring to FIG. 1B, rather than permanently altering the backpack with eyelets, strap strips 200 may be temporarily attached parallel to the zipper strips. The strap strips themselves can take varying embodiments, as seen in the two different types of strap strips on each shell of the backpack. Referring to a close-up view in FIG. 11, on shell 16, the strap strip used is a single, double-layer thick of material folded back on itself at the end 204, sewn together at specific sections 210, such that between the top and bottom portions, open loops 255 are created. This strap strip is then attached to the shell using fasteners 250 that, in this example, are magnetic pin tags (e.g., those used in retail security), which provide a secure attachment and may be removed, leaving only a small hole in the shell material where the pin or shaft of the fastener passes through. On shell 12, the strap strip used further illustrates the flexibility of design. This strap strip consists of two independent, single-layered, distinctly colored straps of material 260 and 262 that are overlaid on top of each other but not sewn together. Rather, the fasteners 250 are used to join both straps to each other and to the shell. The top strap 262 is longer than the bottom strap 260 such that, between the points of joining at each fastener 250, there is more material in the top strap, resulting in open loops 255 being created between each fastener.

Once modifications are made to each shell, on the left side of the backpack, a cord or rope 300 is threaded through the first set of eyelets 100 (FIG. 1A) or open loops 255 (FIG. 1B) closest to the bottom on both shells. Each end of the cord then passes through the next above eyelet or open loop on the opposite shell from where it was first threaded. This continues upward with both ends of the cord, resulting in an X-pattern 304 woven across the opening of the backpack 30 along each side. Each end of the cord stops lacing on each side of the backpack once the fabric begins to turn horizontal to create the top of the backpack roughly at point 302. Excess cord is tied off with knots 310 (visible in FIG. 1A), and left to dangle 320.

Figure 2:
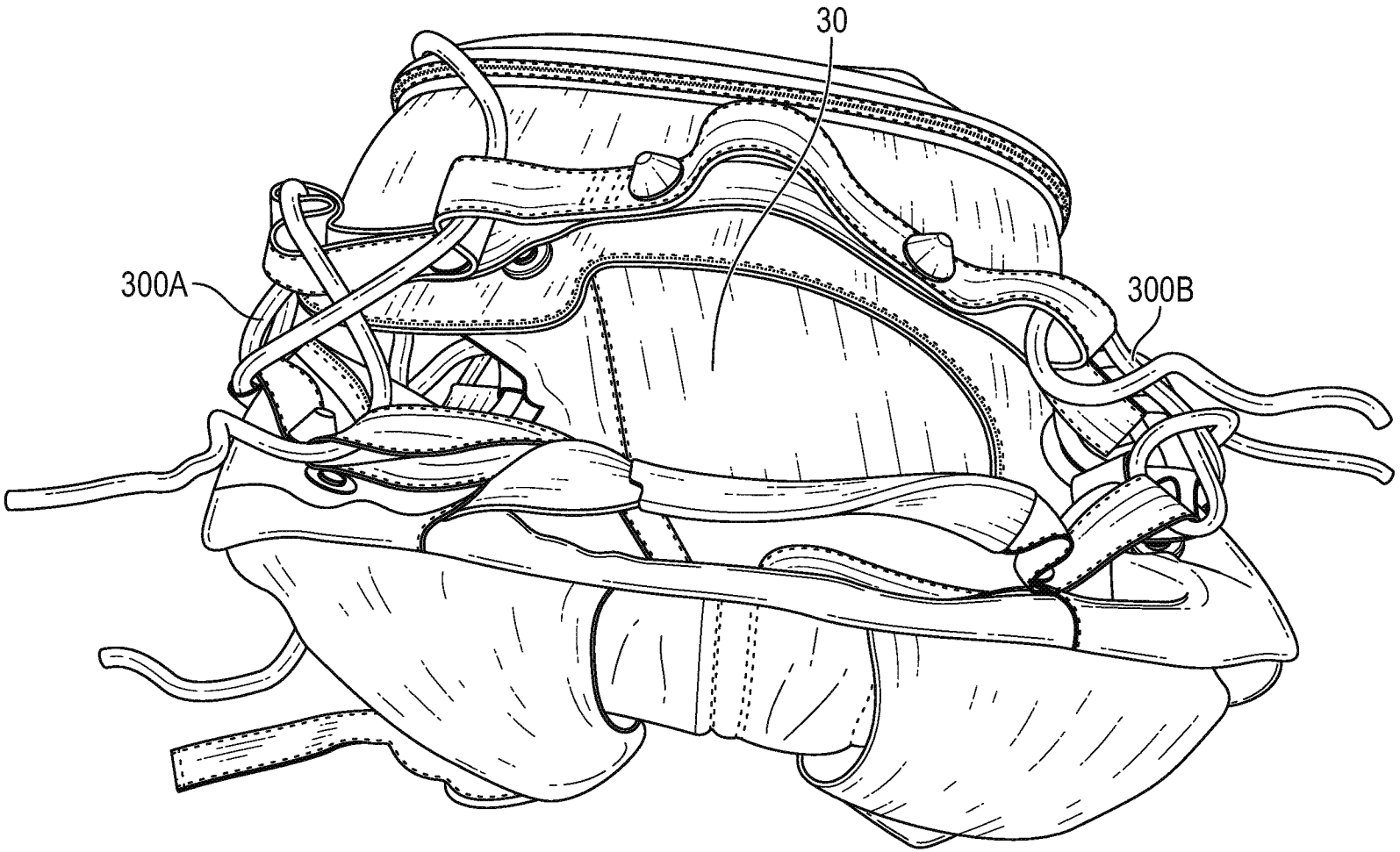
FIG. 2 shows a backpack from the top view.

FIG. 1A shows this description on the left side of the backpack. The same is duplicated on the right side using a separate cord. Referring to FIG. 2, using a separate left cord 300A and right cord 300B helps to avoid any need for unlacing at the top of the backpack each time an item is loaded into the backpack opening 30.

Despite such modifications, backpack 10 may continue to be used as a conventional backpack, with or without the cords present. However, the volume of the backpack and the size and shape of items the backpack can hold is limited if the zipper has to be closed to secure contents.

Figure 3B:
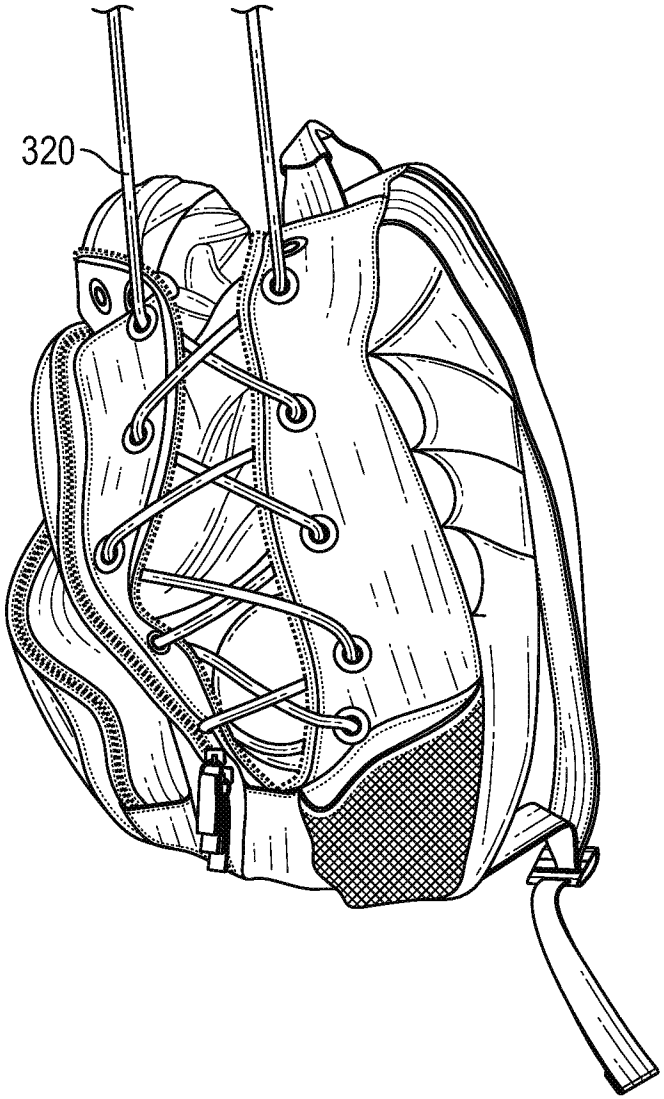
FIG. 3B shows the backpack of FIG. 3A with a more tightened drawstring.
Figure 3A:
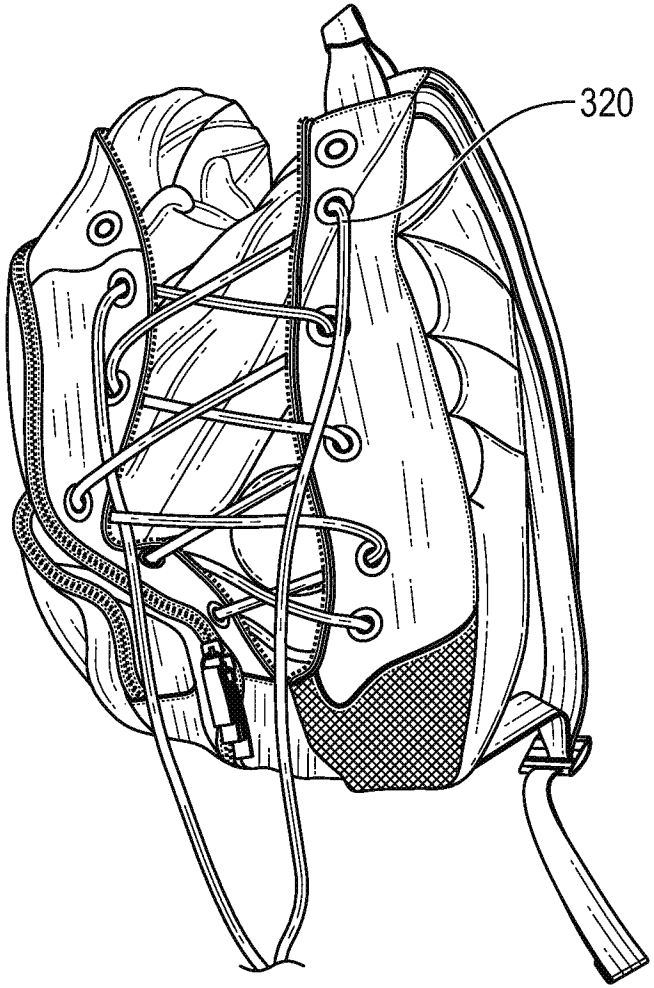
FIG. 3A shows a backpack from the left side view with bulky contents and a loose drawstring.

Turning to FIG. 3A, the backpack has been filled substantially to where the conventional zipper could not have been closed. In this case, the contents are secured by applying appropriate force to draw the two shells of the backpack together. For example, by pulling the excess dangle of the cords 320 upward on each side of the backpack, the woven X's tighten and draw the shells together around the contents, example of this happening to left side of the backpack is shown in FIG. 3B. Effectively, the bulk is accommodated by allowing the first and second shells to separate (which a standard zipper doesn't allow), and then the cords hold the two shells close together. The tension prevents contents from moving and potentially slipping out through the spaces between the cord.

Figure 4B:
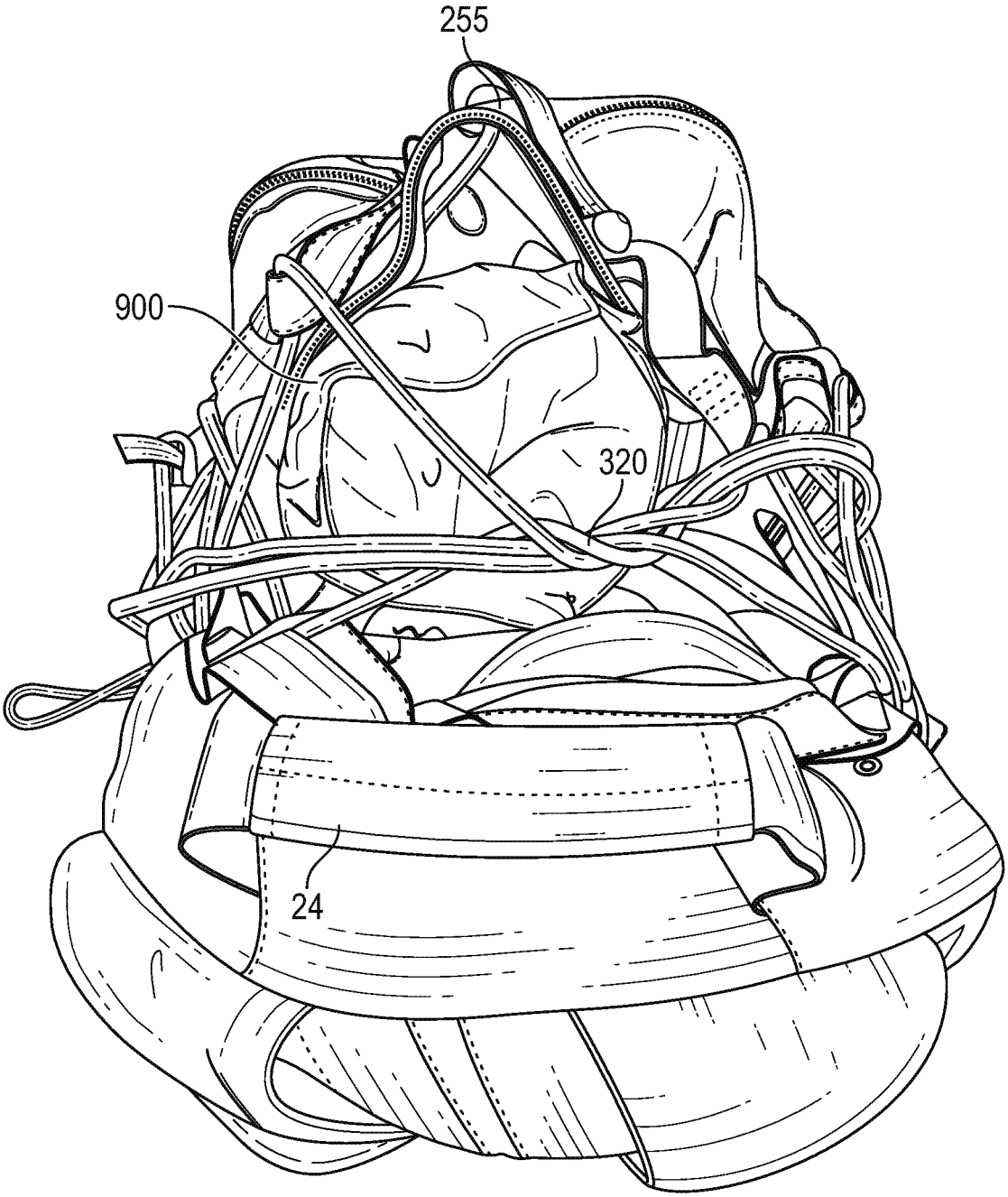
FIG. 4B shows the backpack of FIG. 4A with another embodiment for securing the top.

Turning to FIG. 4A, at the top of the backpack, note that simply tying the top dangle of the cords 320 together applies tension in the left/right directions, which may squeeze the top of the backpack open in the front/back directions; cabbage 900 may fall out. Therefore at the top, it's important to pass the cord through something to redirect tension to the front/back directions instead. On the back shell, we can use existing handle 24. With the front shell, there is no existing handle. With FIG. 4B, the open loops 255 created by strap strips are large enough for the knotted ends of the cord to pass through. With FIG. 4A, the eyelets 100 are too small for the knotted ends of the cord to pass through. Turning to Figure we address this by passing a shorter length of cord 380 through two of the top eyelets 100 and then tie off each end from the inside, to create a second handle 26.

Figure 6A:
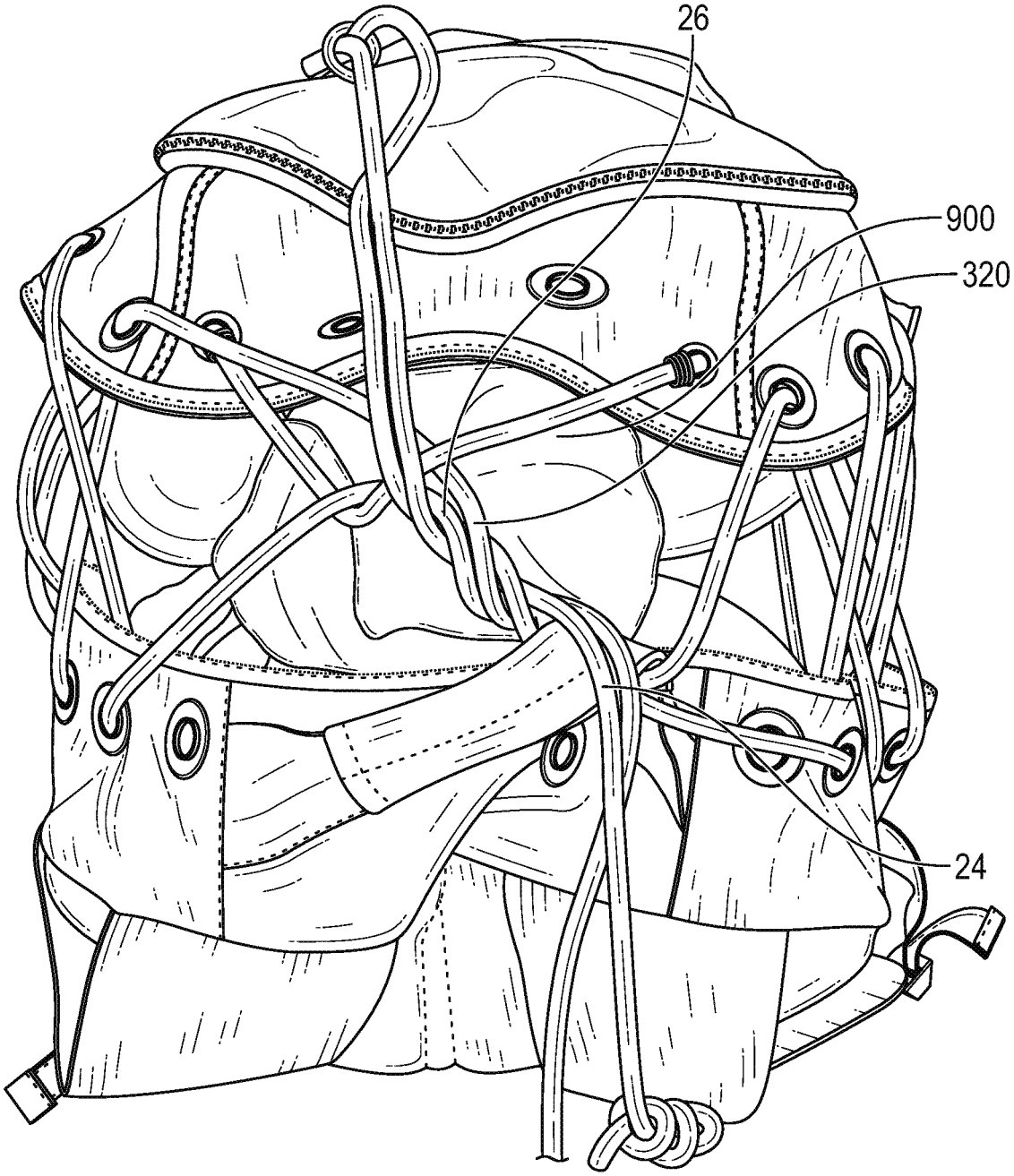
FIG. 6A shows a backpack from the top view with bulky contents and another embodiment for securing the top.
Figure 6B:
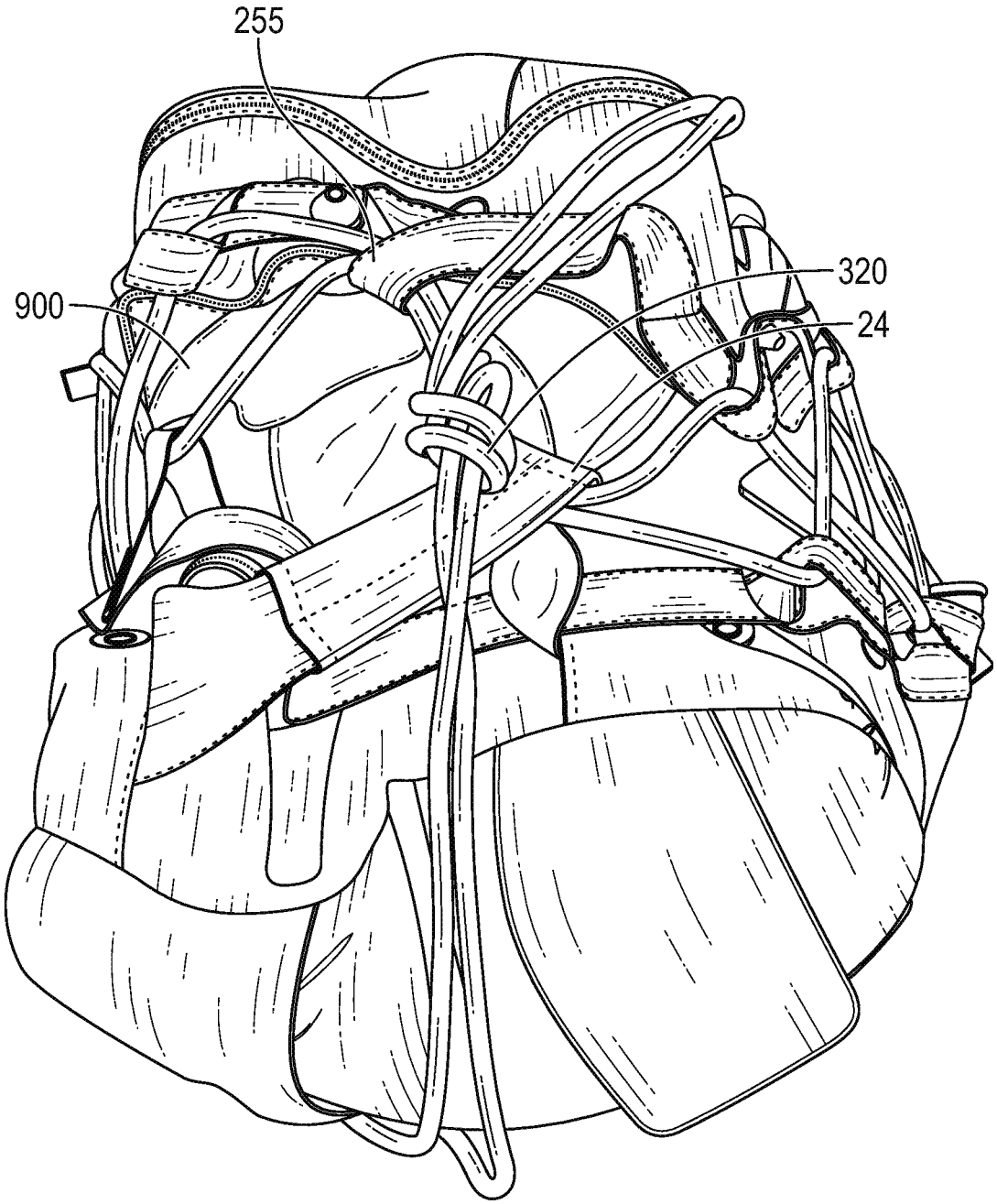
FIG. 6B shows the backpack of FIG. 6A with yet another embodiment for securing the top.

Turning to FIG. 6A, at the top of the backpack, one knotted end passes through the existing first handle 24 on both Figures. The other knotted end passes through our created second handle 26 in FIG. 6A or the top-most open loop 255 in FIG. 6B. Now when we tie off the excess cords 320, we apply tension in the front/back directions to provide a more ideal closure; cabbage 900 is not likely to escape. Of course, depending on the backpack contents, we may not need to be so stringent about closing the top.

Figure 7B:
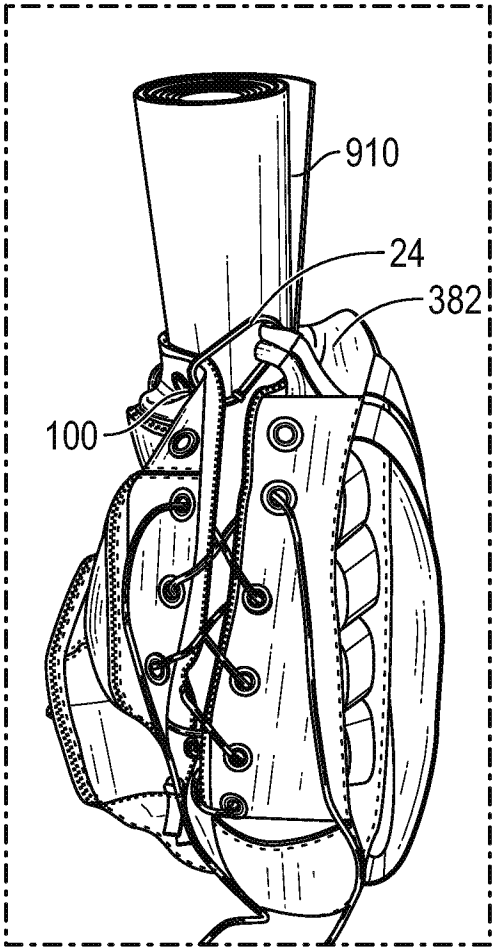
FIG. 7B shows the backpack of FIG. 7A further including a clip.
Figure 7A:
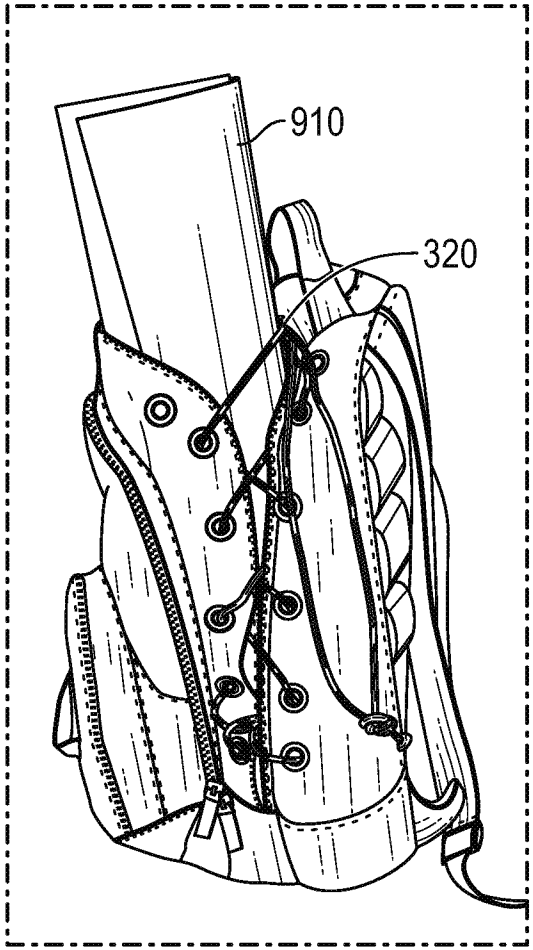
FIG. 7A shows the left side of a backpack from holding a yoga mat.
Figure 7C:
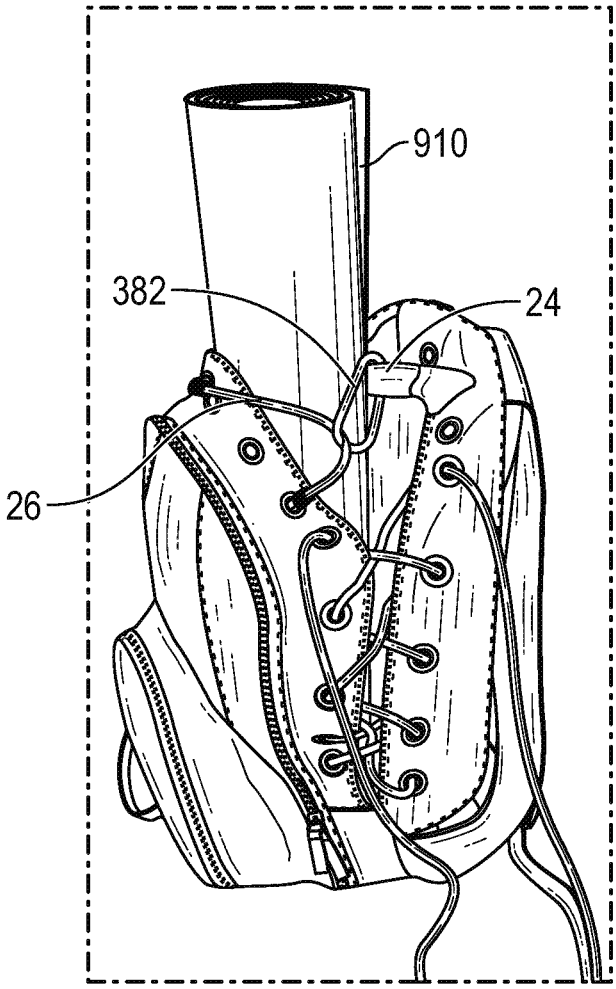
FIG. 7C shows an alternative design with a clip and a handle.

In FIG. 7A an elongated cylindrical item, such as a rolled up yoga mat 910 extends out of the top opening of the backpack, preventing the zipper from being closed. In some situations such as this where the item is majority contained within the backpack, we may not need to worry about direction of tension at the top, and simply tie the excess ends 320 in a left/right direction as in FIG. 7A. We may also not even worry about tying the cords, leaving them to hang freely either inside or outside the backpack and optionally adding a clip 382 to join the two shells using built-in first handle 24 on one shell and then either existing eyelets 100 (or open loops, were that the modification made) in FIG. 7B or created second handle 26 in FIG. 7C.

Figure 8:
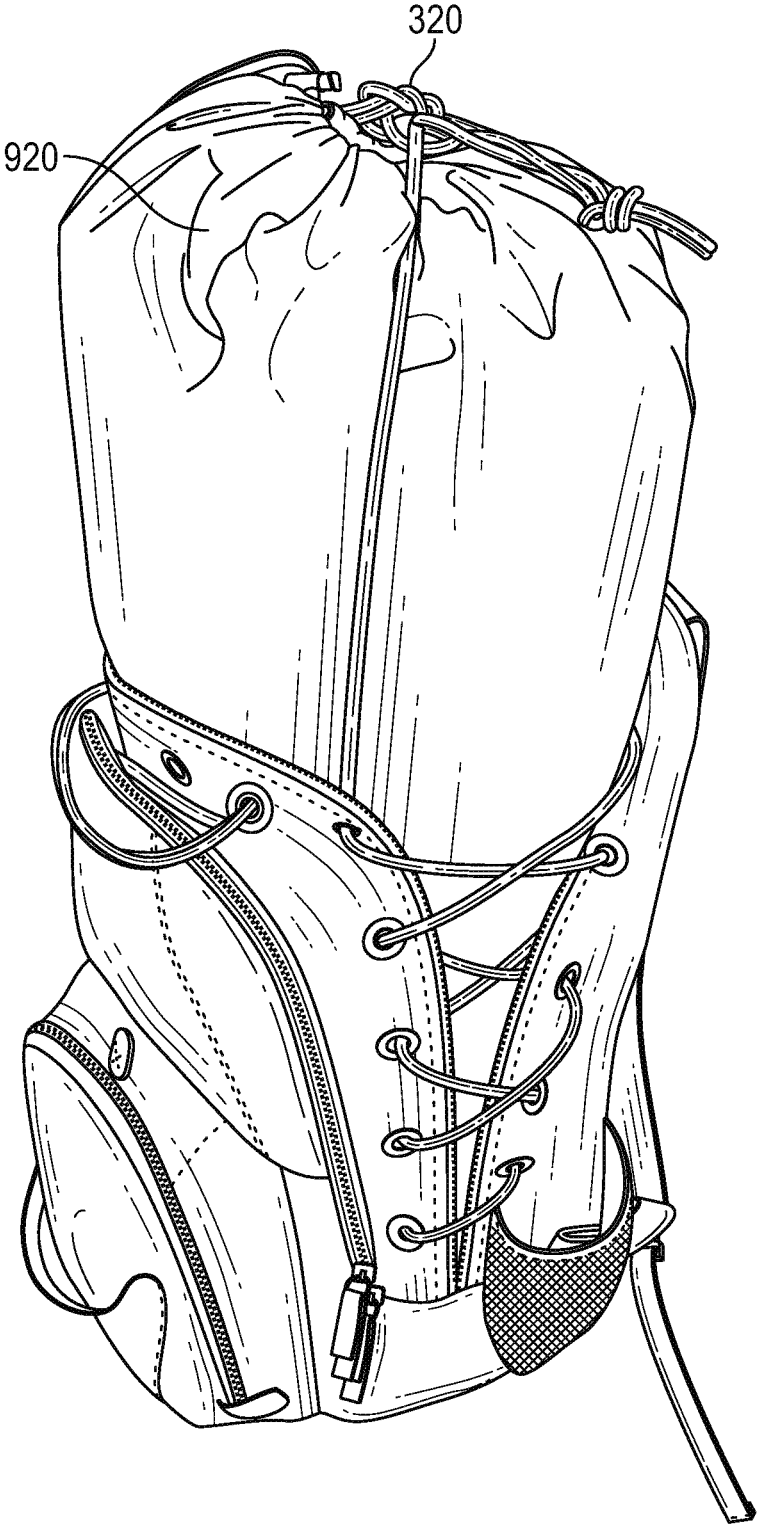
FIG. 8 shows a backpack from the left side view holding a tent.
Figure 9:
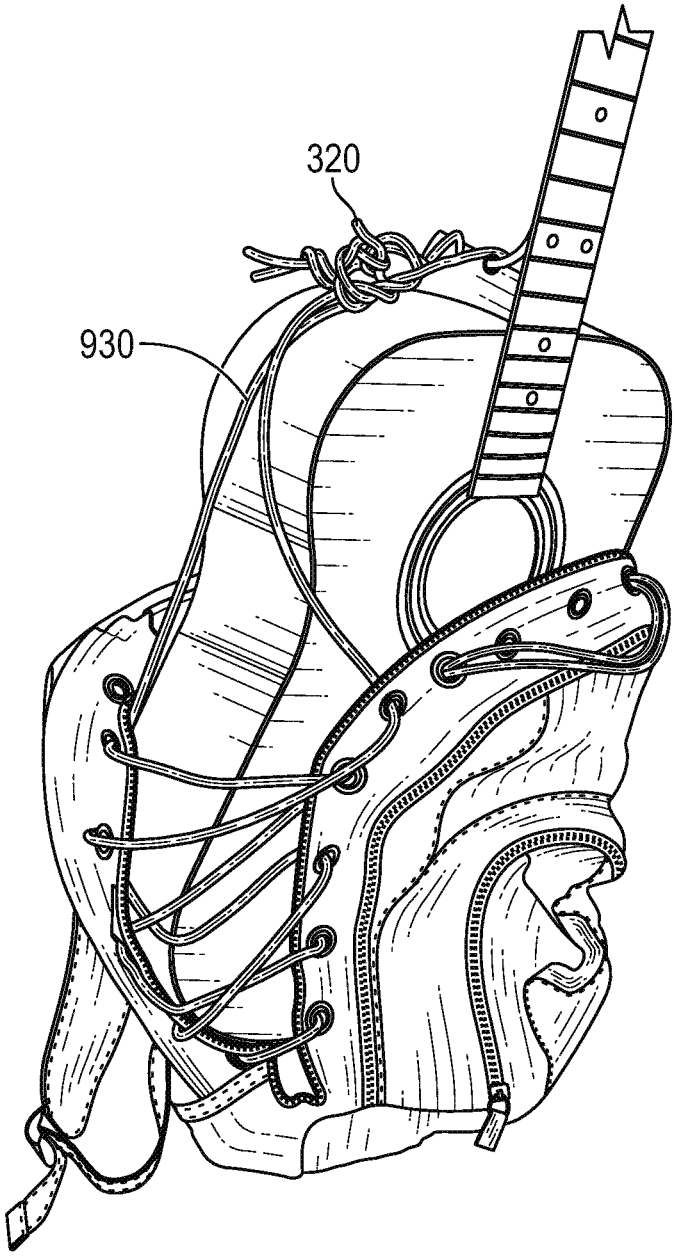
FIG. 9 shows a backpack from the right side view holding a guitar.
Figure 10:
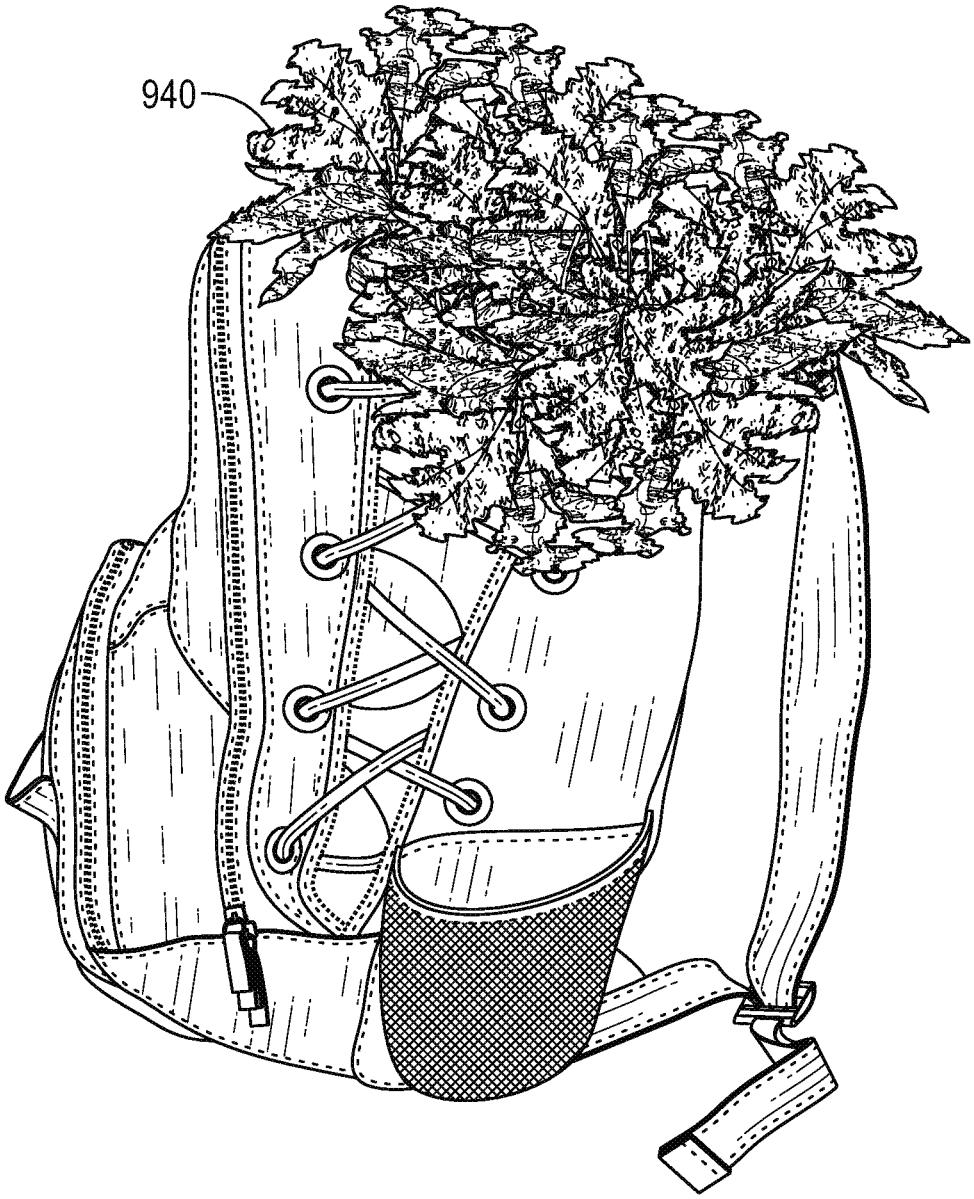
FIG. 10 shows a backpack from the left side view holding vegetables.

Turning to FIG. 8, an extra-large item such as a tent 920 may be placed into the backpack. The item is secured by tying the excess cords 320 on each side of the backpack across the top of the item. When the extra-large item is also of a highly irregular shape, such as guitar 930 as seen in FIG. 9, the width of the lower end of the guitar is accommodated by a much greater separation of the shells as permitted by the woven cord. Besides just being tied at the top, excess cords 320 can also loop around the guitar neck for additional stability, as desired. Finally, the open weave of the cords not only permits bulk but crucially prevents damage, as can be seen by leafy greens 940 placed in the backpack in FIG. 10.

From the foregoing, it will be appreciated that specific embodiments of the invention have been described herein for purposes of illustration, but that numerous alterations may be made without deviating from the scope of the invention. Such alterations may be made for stylistic purposes or to achieve variations in functionality and performance. Accordingly, the invention is not limited except by the appended claims. A non-exhaustive list of such alterations may include:

A) Differences in carrier design that accommodates such modifications, for example:
   i) Whether shoulder straps are/are not present.
   ii) Whether zippers are/are not present.
   iii) Where sidewalls join together to form of the backpack (e.g., point 102 in FIG. 1A can be higher up on the backpack for a smaller opening 30, or all the way adjacent to bottom 14).
   iv) Whether additional pockets, sleeves, or other features are present (e.g., pockets 21 on FIG. 1).

Figure 11:
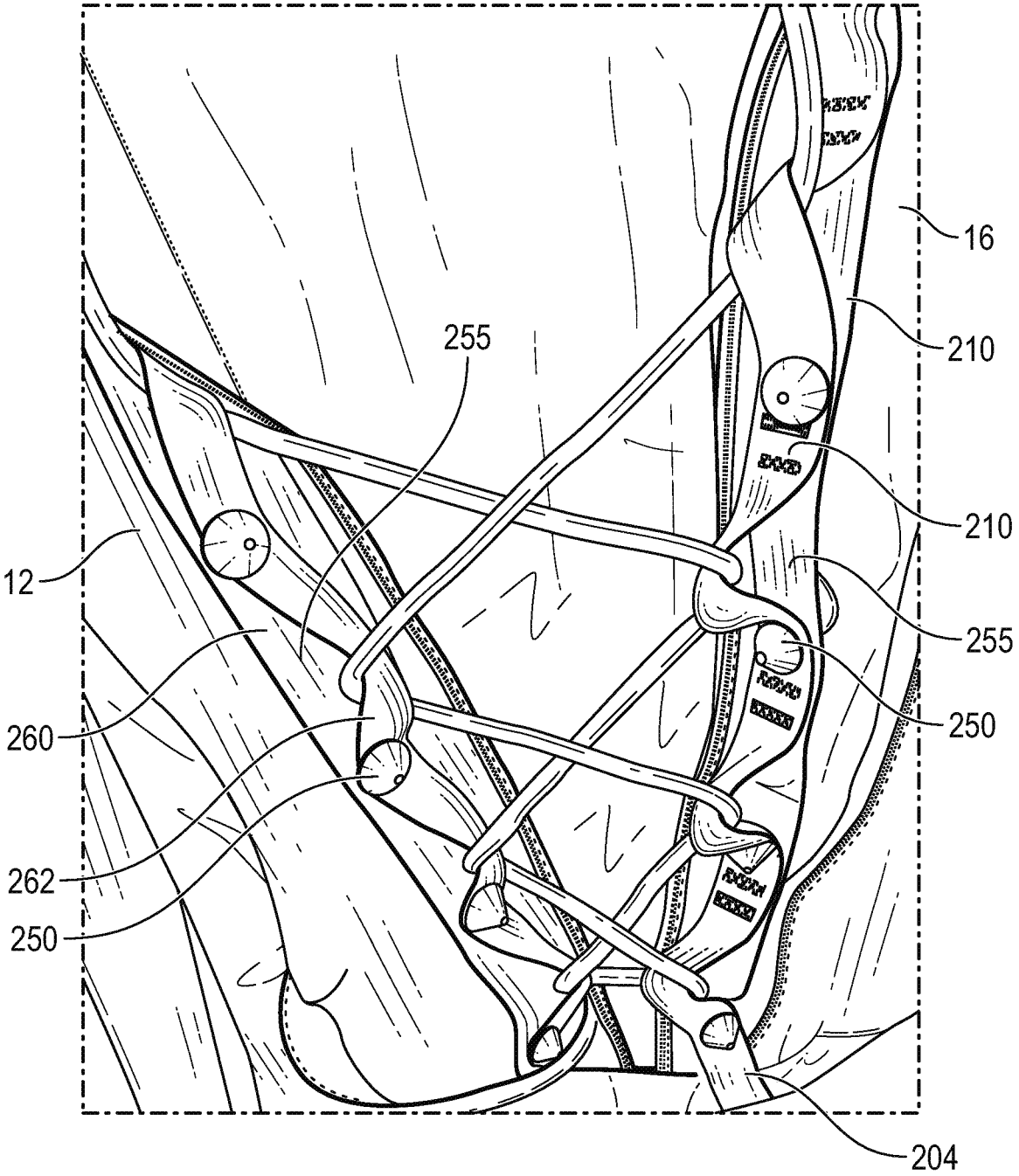
FIG. 11 shows a close-up of the modification made to the backpack first shown in FIG. 1B.
Figure 12:
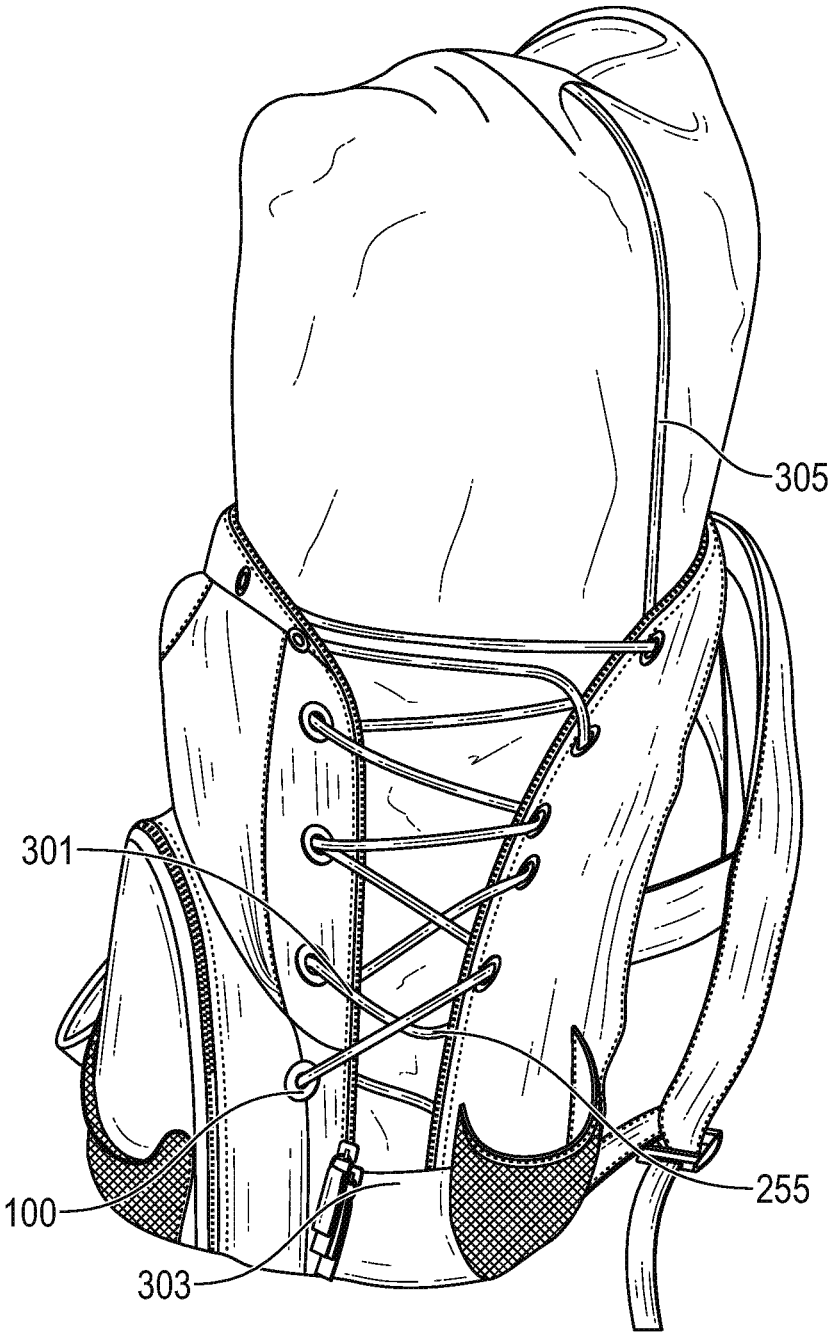
FIG. 12 shows a backpack from the left side view with variations of modifications and threading approaches.

B) Differences in types of modifications used to allow passage of cord across the shells of the carrier, for example:
   i) While FIG. 1B highlights a temporary add-on that doesn't permanently alter the backpack, certainly the strap strips 200 could be made into a permanent modification if, rather than using fastener 250, they were sewn on to the backpack shells.
   ii) One may also prefer to combine FIGS. 1A and 1B, using a eyelet approach on one backpack shell and a strap strip approach on the other shell, as seen in FIG. 12.
   iii) The strap strips, rather than having open loops 255 created by top and bottom portions of strap material, can itself have eyelets created by metal grommets.
   iv) If top and bottom portions of strap strips are previously joined to each other before being joined to backpack as seen with strip 204 in FIG. 11, this joining may be done in various other ways (e.g., with certain glues) besides being sewn as shown by 210 in FIG. 11.
   v) Strap strips may be joined to backpack in various other ways (e.g., with certain glues) besides using fastener 250 as shown in FIG. 11.
   vi) Should modification use eyelets, such eyelets can be created in various other ways (e.g., simply a hole punched through fabric) besides using metal grommets as shown in FIG. 1A.
   vii) Whatever openings the cord threads through on either shell may be aligned (as eyelets 100 are in FIG. 1A or open loops 255 are in FIG. 1B) or not aligned as in FIG. 12 (eyelet 100 and open loops 255 are alternating).

viii) Openings may be spaced closer together (to create more security) or further apart (to create more ease of tensioning).

C) Differences in cord length & threading design, for example:

i) In FIG. 1, cord is threaded through the bottom-most set of aligned openings on both sides to create a loop as shown at point 300, and then each end threads upward, with excess tied off together at knot 310, such that the entire first cord is actually a loop. This is a more secure design shown in FIGS. 1-11. Yet in FIG. 12, an alternative is shown where cord 305 is tied off on the inside of the backpack behind eyelet 100, and then it threads through one side at a time such that at the bottom 303 there isn't a loop and instead a zigzag pattern 301 is formed; while the excess is still tied off the entire first cord is not a loop, but rather a singular strand.

ii) Length of cord used may be of varying lengths such that excess cord beyond the last opening threaded through (e.g., the part that dangles 320 in FIG. 1) is of varying lengths, where the longer, the taller/bulkier are the items that can be accommodated.

iii) Excess cord, whether a single strand, or a loop, may be tied off (as is shown in all Figures) or be secured at the end(s) with a fastener, or not at all (if length is such that there isn't a concern it will easily unthread itself back through the eyelets or open loops).

iv) In all Figures, two cords are used on each side to enable a large opening 30 as shown in FIG. 2 that is permanently open. Still, where unlacing may not be significant (for example for carrying small items that can fit through the weave of the cords, or where cord is an elastic material), a single cord may be used to thread across the entire opening (e.g., both sides and top) of the backpack.

Figure 5:
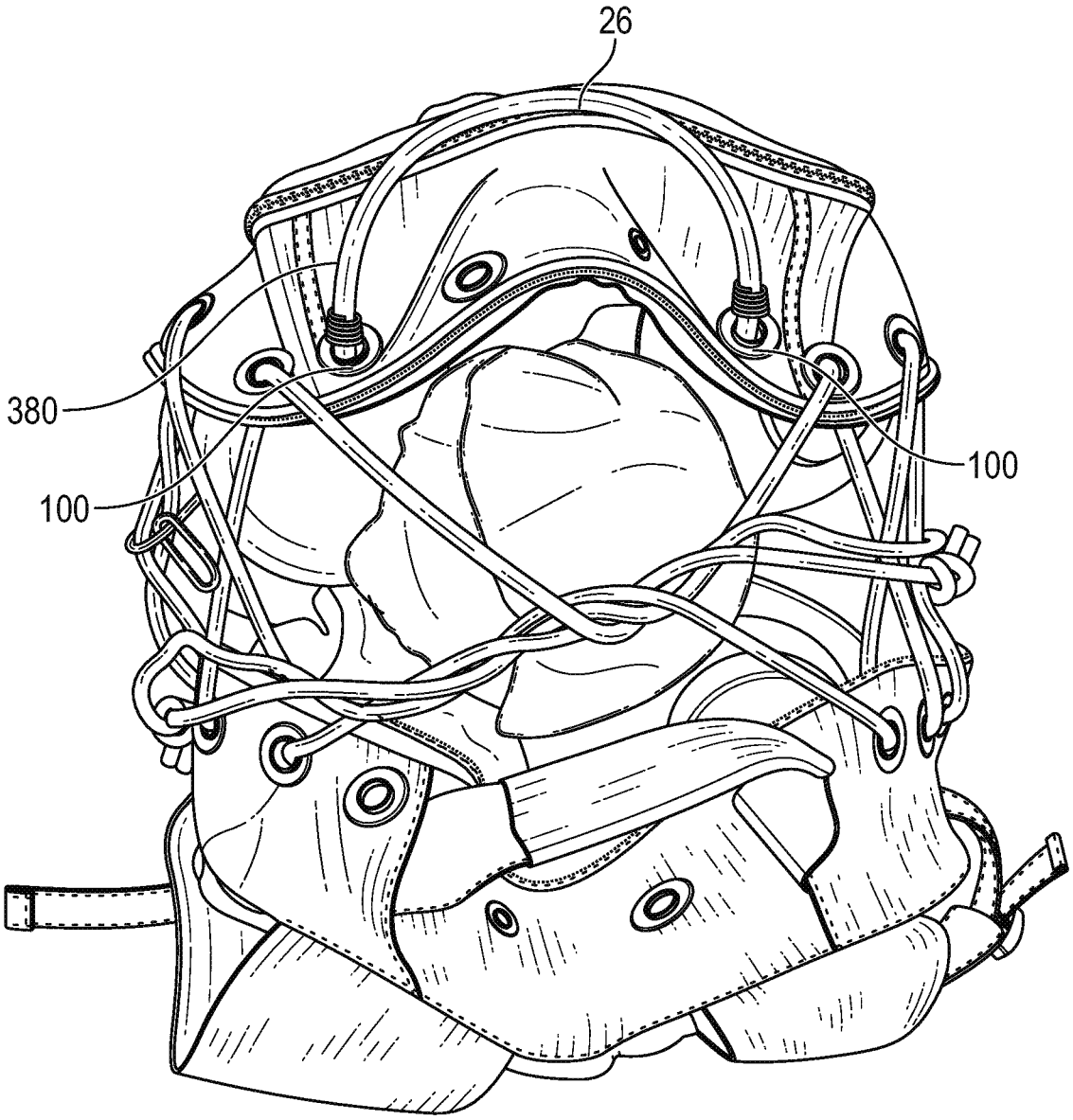
FIG. 5 shows a backpack from the top view with bulky contents and an added secondary handle.

D) Differences to how the top of the backpack is secured and the two cords are joined together, for example:

i) As discussed in FIGS. 4-6, whether or not handles 24 and 26 are present and/or need to be created (which also is determined by size of eyelets 100 or open loops 255, which can be varied, and knots or other strategies used to tie off cord)

ii) As discussed in FIG. 7, whether alternatives such as clip 282 or other fasteners not shown may be used.

E) Differences in properties of materials used, for example:

i) If grommets are used to create eyelets, such grommets can be made of various metals or plastic, with varying properties such as size and whether or not there are spurs or rolled rims).

ii) Strap strip can be made of varying materials such as nylon, polyester, Dyneema, etc., with varying properties such as weave, width, and thickness (including layers).

iii) Cord can be made of varying materials, with varying properties such as length, diameter, elasticity, braid, etc.

iv) Of course, color and style may also vary greatly across all materials used.

The invention may also be described as:

A carrier comprising a first shell having a first set of spaced apart openings; a second shell having a second set of spaced apart openings; and a first cord threaded through the first and second sets of spaced apart openings. The first and second sets of openings may or may not be laterally aligned with each other, and they may be formed by holes punched through the fabric of the carrier and reinforced by grommets.

An additional second cord may be threaded through the first and second sets of spaced apart openings on a second side. The second shell is separable from the first shell by loosening the first cord or both cords. The first shell can be permanently joined to the second shell at a bottom of the carrier. Alternatively the first shell may be permanently joined to the second shell at the first side and second side which are then joined to the bottom of the carrier. The first cord, and the second cord, if used, may be elastic.

A first zipper strip on first shell and second zipper strip on second shell may be used, where the two strips are engageable to each other to attach the two shells together. The first and second zipper strips may extend substantially around a first side, a top, and a second side of the carrier. Additional pockets, sleeves, or holders may be provided on either shell, optionally also with a pair of shoulder straps attached to one shell. In some designs a first handle is located at a top end of the first shell and/or a second handle at the top of the second shell. If used, the first and second handles may be aligned with each other.

I claim:

1. A carrier comprising:

a first shell having a first set of spaced apart openings;

a second shell having a second set of spaced apart openings;

a first cord threaded through the first and second sets of spaced apart openings; and wherein the spaced apart openings are created by the first and second straps, wherein top and bottom portions of each strap are separable to create the openings.

2. The carrier of claim 1 wherein the spaced apart openings are created by holes punched through the straps and reinforced by grommets.

3. The carrier of claim 1 further including first and second sidewalls joined to each other to form a singular sidewall on each side of the carrier, the singular sidewall joining a common bottom.

4. The carrier of claim 1 wherein the second shell is separable from the first shell by loosening the first cord.

5. The carrier of claim 1 having a first zipper strip on the first shell and a second zipper strip on the second shell, the first and second zipper strips engageable to each other to attach the first shell to the second shell.

6. The carrier of claim 1 further including a first handle at a top end of the first shell and/or a second handle at the top of the second shell.

7. The carrier of claim 1 further including fasteners between the spaced apart openings, the fasteners attaching the first and second straps to the first and second shells, respectively.

8. The carrier of claim 1 wherein each strap compromises of single strip of material folded back over itself.

9. A backpack comprising:

a first shell having a first sidewall joined to a first backwall, the first sidewall having a first set of spaced apart openings;

a second shell having a second sidewall joined to a second backwall, the second sidewall having a second set of spaced apart openings;

a first handle at a top end of the first shell and a second handle at the top of the second shell, the second handle aligned with the first handle;

the first and second backwalls and sidewalls permanently joined to a common bottom;

a first cord passing threaded through the first and second sets of spaced apart openings on a first side of the backpack;

a second cord threaded through the first and second sets of spaced apart openings on a second side of the backpack; and a pair of shoulder straps attached to the first shell.

10. The backpack of claim 9 further including a first zipper strip on the first shell and a second zipper strip on the second shell, the first and second zipper strips engageable to each other.

11. The backpack of claim 9 wherein the spaced apart openings are created by holes punched through the first and second shells.

12. The backpack of claim 9 wherein the first and second sidewalls are joined to each other to form a singular sidewall on each side of the backpack, and the singular sidewall and the first and second backwalls are joined to the common bottom.

13. The backpack of claim 9 wherein the first set of openings are provided by a first strap attached to the first shell and the second set of openings are provided by a second strap attached to the second shell.

14. The backpack of claim 13 further including fasteners between the spaced apart openings, the fasteners attaching the first and second straps to the first and second shells, respectively.

15. A backpack comprising:

a first shell having a first sidewall joined to a first backwall, and the first sidewall having a first set of spaced apart openings;

a second shell having a second sidewall joined to a second backwall, and the second sidewall having a second set of spaced apart openings;

the first and second backwalls and sidewalls permanently joined to a common bottom;

a first cord passing threaded through the first and second sets of spaced apart openings on a first side of the backpack;

a second cord threaded through the first and second sets of spaced apart openings on a second side of the backpack;

the spaced apart openings created by holes punched through the first and second shells and reinforced by grommets; and a pair of shoulder straps attached to the first shell.

16. The backpack of claim 15 further including a first zipper strip on the first sidewall and a second zipper strip on the second sidewall, the first and second zipper strips engageable to each other to attach the first sidewall to the second sidewall.

17. The backpack of claim 15 further including a first handle at a top end of the first shell and a second handle at the top of the second shell.

18. The backpack of claim 15 wherein the first and second sidewalls are joined to each other to form a singular sidewall on each side of the backpack, and the singular sidewall extends down to join the common bottom to which the first and second backwalls are joined.

19. The backpack of claim 15 wherein each strap compromises of single strip of material folded back over itself.

* * * * *